United States Patent [19]

Menzel et al.

[11] 4,254,075

[45] Mar. 3, 1981

[54] METHOD FOR FORMING HOLES IN A MEMBER

[75] Inventors: S. W. O. Menzel, Adelaide, Australia; David E. Mominee, Alpine, Calif.

[73] Assignee: Reed Irrigation Systems, El Cajon, Calif.

[21] Appl. No.: 889,418

[22] Filed: Mar. 23, 1978

[30] Foreign Application Priority Data

Apr. 1, 1977 [AU] Australia ..... PC9638

[51] Int. Cl.[3] ..... B28B 1/48

[52] U.S. Cl. ..... 264/154; 264/156; 408/1 R; 408/50

[58] Field of Search ..... 264/154–156, 264/68; 156/73.5; 425/290; 83/15, 16, 27, 28, 54, 146, 171; 408/1, 7, 9, 12, 68, 67, 704, 714, 124

[56] References Cited

U.S. PATENT DOCUMENTS

| | | | |
|---|---|---|---|
| 669,331 | 3/1901 | Thurber | 264/153 |
| 2,862,231 | 12/1958 | Voigt | 264/68 |
| 3,562,377 | 2/1971 | Zetzsche | 264/156 |
| 3,580,793 | 5/1971 | Hewitt | 156/73.5 |
| 3,662,941 | 5/1972 | Gage | 156/73.5 |
| 3,683,736 | 8/1972 | Loose | 83/16 |
| 3,874,808 | 4/1975 | Zachardelli et al. | 408/1 |
| 3,899,265 | 8/1975 | Lang | 425/290 |
| 3,957,386 | 5/1976 | Lupke | 83/54 |
| 4,012,161 | 3/1977 | Shultz | 408/1 R |
| 4,088,417 | 5/1978 | Kosmowski | 408/1 R |

OTHER PUBLICATIONS

Randolph et al., "Plastics Engineering Handbook", Reinhold, N.Y. (1960) pp. 50 & 51.

*Primary Examiner*—Jay H. Woo

*Attorney, Agent, or Firm*—Gordon L. Peterson

[57] ABSTRACT

A method of forming holes in plastic tubes which includes advancing a rotating shaft into and through the wall of the tube while maintaining a rate of rotation sufficient to cause the material of the tube to be distressed sufficiently to fluidize and/or disintegrate from the area of operation of the shaft, moving the shaft from the hole, and allowing the periphery of the hole to solidify.

16 Claims, 8 Drawing Figures

METHOD FOR FORMING HOLES IN A MEMBER

This invention relates to the formation of holes in plastic tubes.

In irrigation conduits formed for instance of a flexible imporous polymer material, it has been customary to form small holes either in the wall of the tubes themselves or in sections forming part of the tube to which water is supplied at a lower pressure, such holes being of necessity of relatively exact diameter and being cleanly formed without burrs or the like so that regulated amounts of water can flow through the holes.

THE PRIOR ART

There have been various problems in connection with the formation of holes in polyethylene and like tubes and a method of the present use is to utilize a laser beam so adjusted that it can "track" with the tube and burn holes of 0.25 to 0.5 millimeter in diameter. Such a system is described in Australian Letters Pat. No. 486,544 in the name of Reed Irrigation Systems dated January 4, 1974, and entitled "Creating Holes in Flexible Members" or corresponding U.S. Pat. Nos. 3,808,394 and 4,028,525. Such systems are effective but involve extremely complex and costly equipment and the object of the present invention is to provide a system in which holes will be cleanly and accurately formed but without the need to use a laser device.

Another system uses a shaft-like piercing tool which is rotated at a relatively low speed, and after piercing a tube is canted at an angle which exceeds the elastic limit of the polyethylene or similar polymer material, such a method being described in U.S. Pat. No. 3,562,377 in the name of J. B. Zetzsche, dated Feb. 9, 1971. A further object of the invention is to provide a system in which the canting, without which the required hole is not formed, is not required as this involves cold forming the material if a hole of a required shape and accuracy is to be achieved.

One of the problems in forming holes in polyethylene and similar polymer material is that this type of material, because of its melting point, cannot readily be drilled in a normal manner because the material tends to become fused to the drill with the result that a neat hole cannot be made by such a method. The resiliency of the material and secondly the relatively critical melting point of the materials is the reason why a laser beam has been used and is also the reason why cold forming has been proposed.

Objects of the present invention therefore provide an effective method of making holes in irrigation conduits formed of polymer materials, a further object being to ensure accuracy as the holes serve as metering means, and a still further object being to allow shaped holes to be produced, such as slits.

THE INVENTION

According to this invention holes or slits are formed by utilizing a member which is rotated at high speed, such as a metal shaft, which will be generally referred to herein as a "shaft" which shaft, it has been found, can form an effective hole, either a plain bore or a slit or other configuration, provided it is rotated at a high speed preferably in excess of 100,000 r.p.m. Thus, a high speed turbine drill running at perhaps 100,000 r.p.m. to 400,000 r.p.m. and carrying a smooth metal shaft of the required diameter, has been found, on contact with the polymer material, to penetrate the material and provide a neat hole, the material flowing to be displaced to form the hole. The preferred speed range is 240,000 r.p.m. to 360,000 r.p.m.

The shaft can be of round cross section or of other cross section such as oval or octagonal and does not require a shape similar to drills at present used nor does it need to have a configuration such as is given to dental burrs, but the shape of the shaft would depend on the particular size of the aperture which is required and the thickess of the material and other factors, the invention operating on the principle of displacement of the material where the aperture is being formed by causing fluidization of the material as a result of disintegration of the material, melting or flowing of the material due to heat generated by friction between the shaft and the material, or other factors. Therefore, any device which operates at a sufficient speed to cause "flow" or "fluidization" of the material is included.

Thus, if a shaft is selected which has a required diameter and is carried in the chuck of a high speed turbine drill, the forming of holes in the tube can be readily carried out, the process leaving no burrs because the shaft as it penetrates the wall of the tube defines the shape of the hole and leaves a smooth and well-formed wall surrounding the hole, the high speed preventing any significant quantity of the flowing material from adhering to the drill as it is a liquid.

The shaft can be of steel of smooth surface and may be parallel-sided or tapered, or it can have a shaped end similar to a dental burr, so long as it causes the material to be distressed sufficiently to fluidise or disintegrate from the area of operation.

The hole-forming shafts may be synchronized to the speed of the tube during its production mode, as it passes over a programmed wheel, from which the shafts project, or by projecting up one of a multiple of such shafts longitudinally along the tube during its production mode, in the latter case the tube being momentarily stopped as the shafts form the holes in the walls.

The invention also has application to tubes of the type which have a secondary conduit formed as part of the main tube into which secondary conduits water is allowed to flow from the main tube, and these secondary tubes are then apertured in the same way. The holes can be formed in these secondary tubes by routing openings in the secondary tubes by a quick cut across the secondary tube, and depending on whether the tube is stopped in motion during the routing process or continues to move, the aperture in the capillary can be either a clean, square cut or a diagonal cut brought about when the direct angle cut is being made while the tube is in motion.

Thus for instance a main tube can be extruded of a suitable polymer material to have on its periphery one or more capillary tubes which form secondary channels for the flow of water and these capillary tubes open into the main tube at appropriate location to receive a supply of water and the water is then allowed to flow out of the capillary tubes by forming the holes in the capillary tubes, either by piercing or by moving the shaft across the capillary tubes to rout out the holes.

These tubes are readily formed by extruding a ribbon of polymer material having on it the capillary tube or a series of capillary tubes, and according to one form of this invention, the capillary tubes are then pierced from both sides at appropriate intervals, after which the ribbon is curved around and the longitudinal edges are joined by welding or other means. The drawings refer particularly to this type of manufacture but the invention need not be limited thereto.

The actual mechanism can conveniently be any high speed turbine drill to which are attached the shafts which because of their high speed operation can rapidly form a hole of the required configuration either in the main tube or in secondary or capillary tubes forming part of the main tube.

DESCRIPTION OF THE ILLUSTRATED EMBODIMENT

Figure 1:
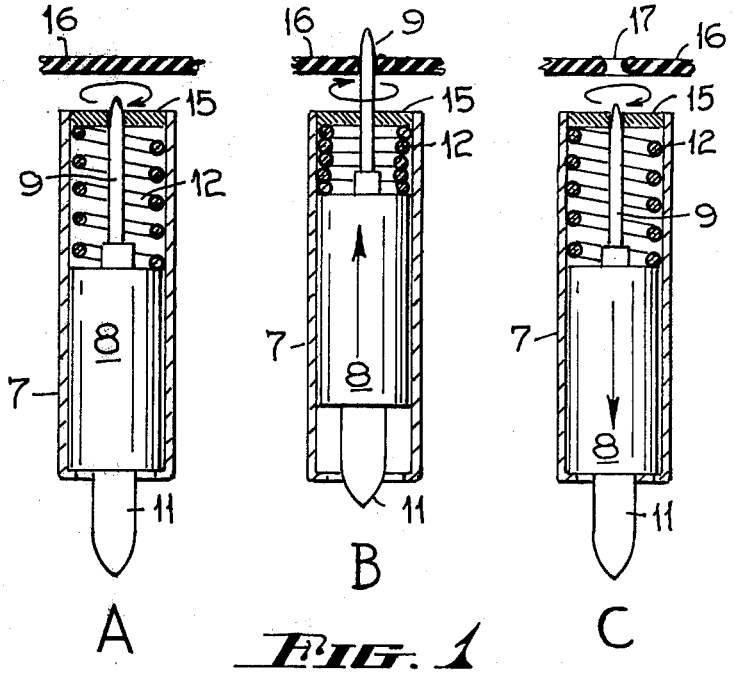
FIG. 1 is a somewhat schematic sectional view showing a shaft projecting from a high speed air motor movable axially within a frame to allow the shaft to pierce a membrane, FIG. 1A showing the commencement of the operation, FIG. 1B showing the shaft advanced and moved through the membrane, FIG. 1C showing the shaft retracted to show the aperture which has been formed by the shaft.

Referring first to FIG. 1, a housing 7 has slidably supported within it a high speed air motor 8 which has on it a shaft 9 which is the member which pierces the membrane or tube to form a hole.

In the use the motor and shaft are urged outwardly in the direction of the arrow by a mechanism later described, contacting a stem 11 secured to the motor and moving the motor against the action of a spring 12.

The shaft 9 passes through an aperture in a die 15 which is preferably an apertured sapphire held in the housing 7 the purpose of which is to clear the shaft 9 of any material which may adhere to it after a piercing action, although normally the shaft remains relatively clear, and to ensure that the shaft retains its critical diameter, the shaft 9 being projecting outwardly through the die 15 during the piercing action but then being retracted and during the retracting action the die removes any material which may have adhered to the shaft. If the material is not removed from the shaft 9, it builds up on the shaft, and consequently, any hole subsequently formed with the shaft has an enlarged diameter.

The membrane is indicated by 16 and can take any form, and this membrane would be suitably located in relation to the shaft 9 to enable the shaft to penetrate the membrane to form a hole 17 as shown particularly in FIG. 1C.

Figure 2:
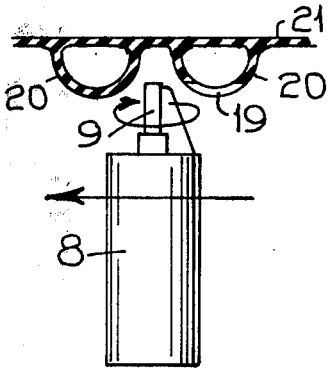
FIG. 2 shows how by moving the motor and shaft sideways a capillary tube can be transversely slitted.

In FIG. 2 is shown how the motor 8 and shaft 9 may be moved sideways to form a slit 19 in a pair of capillary tubes 20 formed on a ribbon 21 which is subsequently to be formed as a tube.

Figure 3:
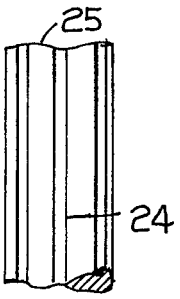
FIG. 3 is an enlarged view of a shaft showing how it can have a blunt end and can be fluted.

In FIG. 3 is shown how the operative end of a modified shaft 24 can have a rough end 25 and can have longitudinal flutes, but it will be realised that the shape can be widely varied and the shapes shown are not to be limiting.

Figure 4:
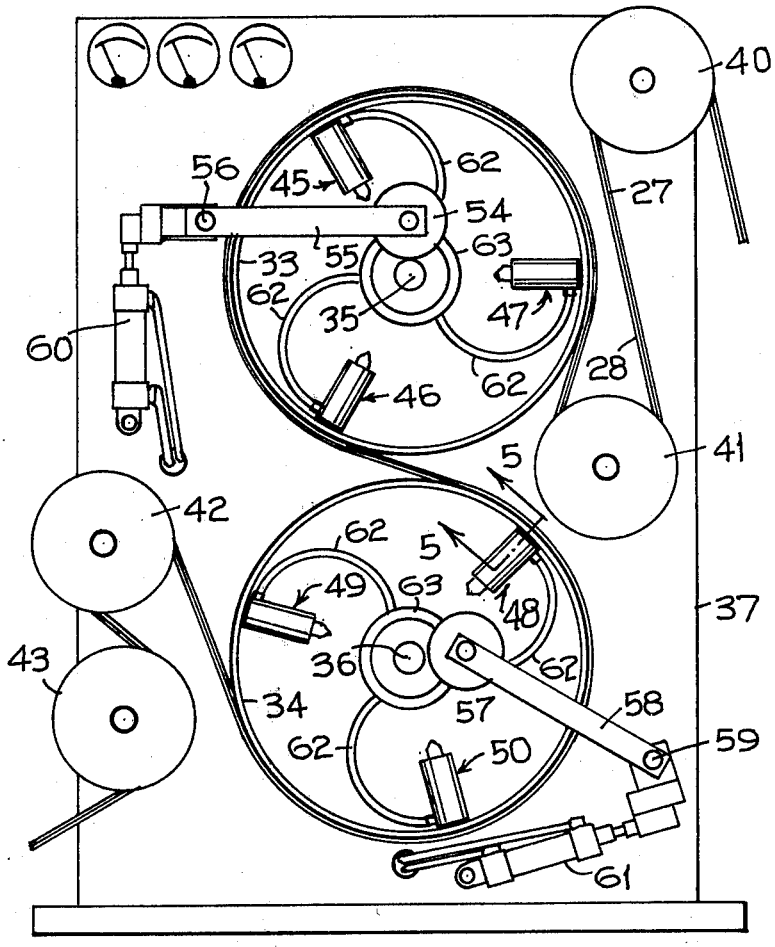
FIG. 4 is a somewhat schematic view showing how the invention can be applied to piercing a membrane in the form of a double-compartment tube in which a ribbon is pierced from two sides prior to joining the two edges of the ribbon to form the irrigation tube.
Figure 5:
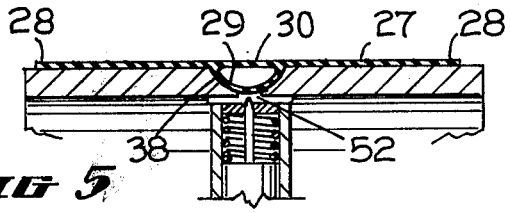
FIG. 5 is a schematic section of the strip and piercing mechanism shown in FIG. 4, showing how it is carried on a wheel, the section being taken on line 5—5 of FIG. 4.

Referring now to FIGS. 4 and 5 where the device is arranged to pierce irrigation tubes of the type earlier referred to in which a ribbon 27, which is subsequent to piercing formed into a tube by joining the two marginal edges 28 of the ribbon, has on it a capillary tube 29 which is apertured through the common wall 30 of the tube to allow mains pressure fluid to flow into the capillary tube 29 and to then lose pressure by flowing along the capillary tube to issue from the capillary tube through a hole in the outer wall of the capillary tube, the holes through the common wall and the outer wall being of course placed at different locations to give the necessary length of the flow path between the inner and the outer holes.

The machine for effecting this piercing comprises a pair of counter rotating indexing wheels 33 and 34 mounted on spindles 35 and 36 and driven by any suitable means, the spindle bearings being supported on a frame 37.

The periphery of each of the wheels 33 and 34 is adapted to accommodate the ribbon 27 which is later formed into a tube, the wheel 33 having a flat outer surface but the wheel 34 having a circumferential groove 38 in it to accommodate the capillary tube 29.

The ribbon 27 passes around guide pulleys 40 and 41, then around the wheel 33 and then around the wheel 34 to leave the area over the guide pulleys 42 and 43, and it is during the passage over the wheels that the ribbon is apertured from both sides at selected localities to form the holes.

The aperturing is achieved by utilizing similar devices to these illustrated in FIG. 1 and similar reference numerals are used, the devices being sequentially numbered 45, 46 and 47 on the wheel 33, and 48, 49 and 50 on the wheel 34, each of the devices comprising the housing 7 within which is the high speed air motor 8 carrying the shaft 9, each shaft 9 being disposed so that it can be projected through an aperture in the rim of the wheels 33 and 34 (see aperture 52 in FIG. 5) when the stem 11 is actuated by a roller 54 on an arm 55 supported from an axle 56 in the case of the wheel 33, and a roller 57 on an arm 58 supported on an axle 59, in the case of the wheel 34, the axles 56 and 59 being supported from the frame 37.

The arm is controlled by a controller 60 while the arm 58 is controlled by a controller 61, the controllers 60 and 61 being programmed to project the rollers 54 and 57 into the path of the stems 11 whenever an aperture is to be formed. In this way the spacing of the holes in the ribbon can be selected, particularly when a multiplicity of piercing stations are used, say three as illustrated.

Air to the air motors is in each case taken through a suitable line 62 from a commutator 63 or similar device.

Such a system is less costly and intricate than when using laser devices or piercing and cold forming and produces clean, neat holes and because of the high speed of rotation of the shafts it is found that the problems associated with ordinary drills are obviated, which troubles at low speed generally are due to pressure distortion of the material, for it will be realised that with a low speed drill or piercer considerable pressure is required to cause the mechanism to penetrate the polymer materials, which in itself causes distortion of the material, whereas with a high speed device as envisaged according to this invention the pressure distortion is not present, and also in the case of capillary or secondary tubes it is possible to make the holes by transverse movement of the shafts in relation to the tubes and therefore the depth of cut can be accurately regulated and for instance the capillary tubes can have a small hole formed in it by shafts which operate outside of the plane of the main tube and there is thus no danger of damaging the back of the capillary tubes or the main tube during the formation of the holes.

We claim:

1. The method of forming holes in a plastic member which comprises:

(a) advancing a smooth shaft having a smooth surface with the shaft spinning about its axis into and through the member while maintaining a rate of rotation sufficient to cause the plastic material of the member to fluidize due to the contact of the said smooth surface of the shaft with the same member with at least some of the fluidized material being in flowable form as the result of heat generated by friction due to said contact whereby to displace said material from the area of operation of the said shaft, (b) moving the said shaft from the hole so formed while maintaining the said flowable form of the plastic material between the shaft and the wall of the hole by substantially retaining the rate of rotation of the said shaft while moving it from the hole so formed, (d) allowing the plastic material in flowable form on the member around the said hole to solidify, and (d) removing at least some of any material adhered to the periphery of the shaft.

2. The method of claim 1 wherein the rate of rotation of the said shaft exceeds 100,000 revolutions per minute.

3. The method of claim 1 wherein the rate of rotation of the said shaft is within 20 percent of 300,000 revolutions per minute.

4. The method of claim 1 wherein the said shaft is advanced axially into and through said member and is then retracted axially from the hole so formed.

5. The method of claim 1 wherein said member includes a tube and said shaft is advanced generally transversely to its axis through a curved part of the wall of the said tube.

6. A method as defined in claim 1 including providing a die having an aperture therein with said shaft extending through the aperture in close proximity thereto and moving the periphery of the shaft through the aperture to at least partially remove any material adhered to the periphery of the shaft.

7. A method as defined in claim 1 wherein the rate of rotation of said shaft is greater than 100,000 revolutions per minute.

8. A method of forming holes in a polymer tube comprising:

(a) advancing a smooth shaft having a smooth surface with the shaft spinning about its axis into and through the wall of said tube while maintaining a rate of rotation sufficient to cause the polymer material of the tube to fluidize due to the contact of the said smooth surface of said shaft with the said tube with at least some of the fluidized material being in flowable form as the result of the heat generated by friction due to said contact whereby to displace said material from the area of operation of the said shaft, (b) moving the said shaft from the hole so formed while maintaining the said flowable form of the polymer material between the shaft and the wall of the hole, (c) allowing the polymer material in flowable form on the wall of the said tube around the said hole to solidify, and (d) holding said smooth shaft against inclination during the time that the shaft contacts the tube.

9. The method of forming holes according to claim 8 wherein the flowable form of the polymer material is maintained by retaining the rate of rotation of the said shaft while moving it from the hole so formed.

10. A method as defined in claim 8 including removing at least some of any material adhered to the periphery of the shaft during said step of moving.

11. The method of forming holes in polymer tubes which comprises:

(a) advancing a smooth shaft having a smooth surface with the shaft spinning about its axis into and through the wall of said tube while maintaining a rate of rotation sufficient to cause the polymer material of the tube to fluidize due to the contact of the said smooth surface of said shaft with the said tube with at least some of the fluidized material being in flowable form as the result of heat generated by friction due to said contact whereby to displace said material from the area of operation of the said shaft, (b) moving the said shaft from the hole so formed while maintaining the said flowable form of the polymer material between the shaft and the wall of the hole, (c) allowing the polymer material in flowable form on the wall of the said tube around the said hole to solidify, and (d) providing a die having an aperture therein with said shaft extending through the aperture in close proximity thereto and moving the periphery of the shaft through the aperture to at least partially remove any material adhered to the periphery of the shaft.

12. A method of forming holes in a plastic member comprising:

providing a fluidizing device which includes a shaft mounted for rotation;

providing a first wheel having a rim and at least one of the fluidizing devices mounted on the first wheel radially inwardly of the rim;

rotating the first wheel;

passing the plastic member over the rim of the first wheel while the first wheel is rotating;

spinning the shaft of the fluidizing device;

advancing the shaft while it is spinning through the plastic member while the member is being passed over the rim of the first wheel and while maintaining a rate of rotation sufficient to cause the plastic material of the member to fluidize due to the contact of the shaft with the member with at least some of the fluidized material being in flowable form as a result of heat generated by friction due to said contact, whereby to displace said material from the area of operation of said shaft;

retracting the shaft from the hole so formed while maintaining the flowable form of the plastic material between the shaft and the wall of the hole; and allowing the plastic material in flowable form on the member around the hole to solidify.

13. A method as defined in claim 12 including providing the fluidizing device with a housing and a motor slidable in the housing with the shaft projecting from the motor, said step of spinning the shaft includes utilizing said motor to spin said shaft, and said step of advancing includes urging the motor and the shaft generally radially outwardly of the first wheel.

14. A method as defined in claim 13 including controlling said step of advancing by providing a control member in the path of movement of the fluidizing device.

15. A method as defined in claim 12 wherein the member includes a tube and said hole is formed in said tube and said method includes providing a second wheel having a rim and at least one of the fluidizing devices mounted on the second wheel radially inwardly of the rim thereof, rotating the second wheel in a direction opposite to the direction of rotation of the first wheel, passing the plastic tube from the rim of the first wheel over the rim of the second wheel while the first and second wheels are counterrotating and utilizing the fluidizing device of the second wheel to form an opening in the plastic tube whereby the opening formed by the fluidizing device of the second wheel and the hole formed by the fluidizing device of the first wheel are on opposite sides of the tube.

16. A method as defined in claim 15 including providing the fluidizing device with a housing and a motor slidable in the housing with the shaft projecting from the motor, said step of spinning the shaft includes utilizing said motor to spin said shaft, and said step of advancing includes urging the motor and the shaft generally radially outwardly of the first wheel, controlling said step of advancing by providing a control member in the path of movement of the fluidizing device, controlling the position of the control member to regulate the spacing between the holes formed in the tube by the shaft, providing said shaft with a smooth surface and contacting the smooth surface of the spinning shaft with the tube to bring about such fluidization of the plastic material.

* * * * *